US011718992B1

(12) United States Patent
Carpenter

(10) Patent No.: US 11,718,992 B1
(45) Date of Patent: Aug. 8, 2023

(54) HIP AND RIDGE LINER WITH SHINGLE RETAINING TABS OR CLIPS

(71) Applicant: Ronald Carpenter, Lincoln, CA (US)

(72) Inventor: Ronald Carpenter, Lincoln, CA (US)

( * ) Notice: Subject to any disclaimer, the term of this patent is extended or adjusted under 35 U.S.C. 154(b) by 0 days.

(21) Appl. No.: 18/121,743

(22) Filed: Mar. 15, 2023

Related U.S. Application Data

(63) Continuation of application No. 18/088,538, filed on Dec. 24, 2022, now Pat. No. 11,649,634.

(51) Int. Cl.
*E04D 1/34* (2006.01)
*E04D 12/00* (2006.01)
*E04D 3/40* (2006.01)

(52) U.S. Cl.
CPC ..... *E04D 1/3402* (2013.01); *E04D 3/40* (2013.01); *E04D 12/002* (2013.01); *E04D 2001/345* (2013.01); *E04D 2001/3423* (2013.01); *E04D 2001/3447* (2013.01); *E04D 2001/3461* (2013.01); *E04D 2001/3491* (2013.01)

(58) Field of Classification Search
CPC ..... E04D 1/3402; E04D 1/30; E04D 1/34; E04D 1/28; E04D 1/29; E04D 1/2907; E04D 1/2916; E04D 1/2918; E04D 1/2928; E04D 1/2942; E04D 1/2963; E04D 12/002; E04D 2001/3423; E04D 2001/3432; E04D 2001/3435; E04D 2001/345; E04D 2001/3458; E04D 2001/3461; E04D 2001/3467; E04D 2001/3491; E04D 2001/3408; E04D 2001/3414; E04D 2001/304; E04D 2001/305; E04D 2001/306
See application file for complete search history.

(56) References Cited

U.S. PATENT DOCUMENTS 384,118 A * 6/1888 Bellinger ..... E04D 1/2928 52/525
880,012 A * 2/1908 Christensen ..... E04D 1/2918 52/536
1,509,795 A * 9/1924 Tiner ..... E04D 1/2918 52/526
1,510,534 A * 10/1924 Abraham ..... E04D 1/2918 52/525
1,570,152 A * 1/1926 Hooker ..... E04D 1/34 52/547
1,582,727 A * 4/1926 Bradfield ..... E04D 1/2918 52/545
1,593,408 A * 7/1926 Honigbaum ..... E04D 1/34 411/461

(Continued)

*Primary Examiner* — Jessica L Laux
(74) *Attorney, Agent, or Firm* — Craig A. Simmermon

(57) ABSTRACT

This invention is a hip and ridge liner for a roof on a building. It is a waterproof and weather proof barrier that is installed on top of a hip line or a ridge line on a roof. Hip and ridge shingles are then installed on top of the hip and ridge liner. Embodiments of this invention include a plurality of external tabs which function to securely retain the hip and ridge shingles and keep them in place for many years. Other embodiments of this invention include a plurality of internal tabs which function to securely retain the hip and ridge shingles and keep them in place for many years. Other embodiments of this invention include a plurality of shingle retaining clips which function to securely retain the hip and ridge shingles and keep them in place for many years.

4 Claims, 8 Drawing Sheets

(56) References Cited

U.S. PATENT DOCUMENTS 1,634,972 A * 7/1927 Bartlett ..... E04D 1/34 52/532
1,668,291 A * 5/1928 Topping ..... E04D 1/29 52/546
1,670,469 A * 5/1928 McCarthy ..... E04D 1/26 52/523
1,690,396 A * 11/1928 Block ..... E04D 1/2916 52/529
1,701,704 A * 2/1929 Stinson ..... E04D 1/2928 52/525
1,732,229 A * 10/1929 Harris ..... E04D 1/2928 52/527
1,787,622 A * 1/1931 Goslin ..... E04D 1/2916 52/527
1,795,277 A * 3/1931 Fischer ..... E04D 1/2928 52/526
2,176,156 A * 10/1939 Tamalunas ..... E04D 1/34 52/471
2,486,326 A * 10/1949 Ronzone ..... E04D 1/18 52/526
2,959,898 A * 11/1960 Boarini ..... E04D 1/2928 52/525
4,322,928 A * 4/1982 Freiborg ..... E04D 1/26 52/545
4,434,589 A * 3/1984 Freiborg ..... E04D 1/30 52/748.1
4,439,955 A * 4/1984 Freiborg ..... E04D 1/20 52/57
4,580,389 A * 4/1986 Freiborg ..... E04D 1/30 52/96
4,672,790 A * 6/1987 Freiborg ..... E04D 1/26 52/545
5,094,042 A * 3/1992 Freborg ..... E04D 1/20 52/748.1
5,319,898 A * 6/1994 Freiborg ..... E04D 1/30 52/52
5,352,154 A * 10/1994 Rotter ..... E04D 13/174 454/365
5,365,711 A * 11/1994 Pressutti ..... E04D 1/30 52/553
5,377,459 A * 1/1995 Freiborg ..... E04D 1/30 156/227
5,651,734 A * 7/1997 Morris ..... F24F 7/02 454/365
5,947,817 A * 9/1999 Morris ..... E04D 1/36 454/365
6,070,384 A * 6/2000 Chich ..... E04D 1/30 52/518
6,125,602 A * 10/2000 Freiborg ..... E04D 3/40 52/DIG. 9
6,361,434 B1 * 3/2002 Brandon ..... E04D 13/176 454/365
6,647,675 B1 * 11/2003 Castellanos ..... E04D 12/008 52/302.3
7,073,295 B2 * 7/2006 Pressutti ..... E04D 1/30 52/745.19
7,124,548 B2 * 10/2006 Pressutti ..... E04D 1/30 52/745.19
7,178,306 B2 * 2/2007 Fritz ..... E04D 5/148 52/409
7,604,536 B2 * 10/2009 Coulton ..... F24F 7/02 454/365
7,833,339 B2 * 11/2010 Whitaker ..... E04D 1/26 428/407
8,839,576 B1 * 9/2014 Newcomb ..... E04D 13/0325 52/200
9,085,908 B2 * 7/2015 Desch nes ..... E04F 13/0803
11,434,642 B2 * 9/2022 Van Wey ..... E04D 13/176
2002/0000068 A1 * 1/2002 Freiborg ..... E04D 1/30 29/897
2002/0189189 A1 * 12/2002 Kupczyk ..... E04D 1/26 52/553
2007/0117505 A1 * 5/2007 Wey ..... E04D 13/176 454/366
2007/0144077 A1 * 6/2007 Quaranta ..... E04D 1/30 52/43
2010/0218433 A1 * 9/2010 Quaranta ..... E04D 1/30 52/518
2016/0017608 A1 * 1/2016 Grubka ..... B32B 37/24 156/253
2021/0010268 A1 * 1/2021 Nowacek ..... E04D 3/40

* cited by examiner

HIP AND RIDGE LINER WITH SHINGLE RETAINING TABS OR CLIPS

BACKGROUND OF THE INVENTION

1. Field of the Invention

This invention relates to roofing products and specifically to roofing products that cover and waterproof a ridge line or a hip line of a roof.

2. Description of Related Art

Current roofing practice is to shingle over or tile over a ridge line or a hip line on a roof without placing any sort of liner over the seam in the roof substrate or sub roof that creates the ridge line or hip line. This invention is a liner with a plurality of internal tabs, external tabs, or shingle clips that function to create a water, wind, and ice proof barrier over the seam in the roof substrate or sub roof at a ridge line or a hip line. This invention also functions to lock in and firmly retain shingles installed above the liner using a plurality of internal shingle tabs, external shingle tabs, or shingle clips. This invention is the first ridge line liner or a hip line liner and certainly the first ridge line liner or a hip line liner that includes a plurality of internal shingle tabs, external shingle tabs, or shingle clips as shown and described below.

BRIEF SUMMARY OF THE INVENTION

It is an aspect of hip and ridge liner with shingle retaining tabs or clips to include a waterproof and weather proof barrier covering the seam in roofing substrate at a hip line or a ridge line of a roof.

It is an aspect of an embodiment of hip and ridge liner with shingle retaining tabs or clips to include a plurality of external tabs which help secure hip and ridge shingles to a hip line or a ridge line of a roof.

It is an aspect of an embodiment of hip and ridge liner with shingle retaining tabs or clips to include a plurality of internal tabs which help secure hip and ridge shingles to a hip line or a ridge line of a roof.

It is an aspect of an embodiment of hip and ridge liner with shingle retaining tabs or clips to include a plurality of nail plates which help secure hip and ridge shingles to a hip line or a ridge line of a roof.

It is an aspect of an embodiment of hip and ridge liner with shingle retaining tabs or clips to include a plurality of shingle clips which help secure hip and ridge shingles to a hip line or a ridge line of a roof.

It is an aspect of an embodiment of hip and ridge liner with shingle retaining tabs or clips to include a plurality of shingle hooks which help secure hip and ridge shingles to a hip line or a ridge line of a roof.

It is an aspect of an embodiment of hip and ridge liner with shingle retaining tabs or clips to include a plurality of retaining protrusions on tail hooks which help secure hip and ridge shingles to a hip line or a ridge line of a roof.

DEFINITION LIST

Figure 1:
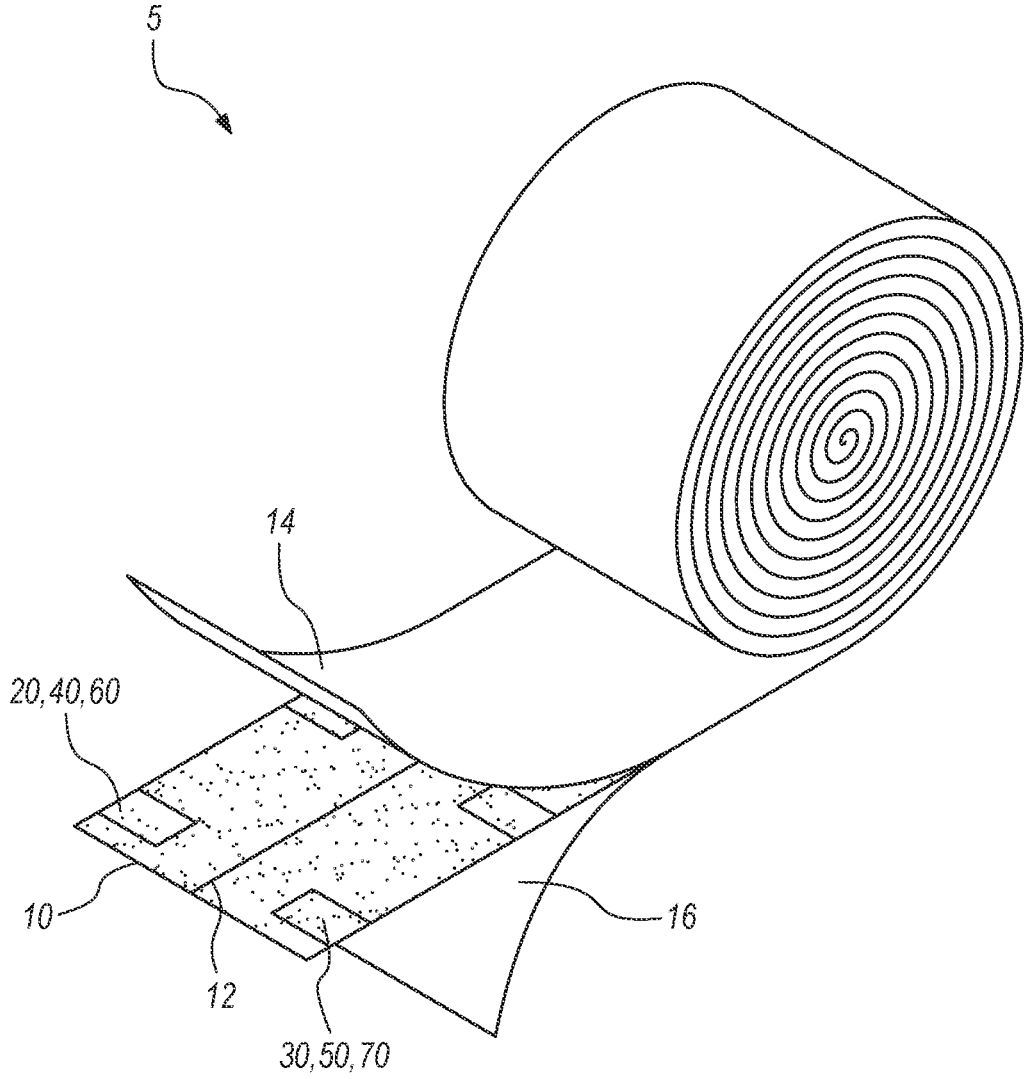
FIG. 1 is a perspective view of hip and ridge liner with shingle retaining tabs or clips wound into a roll, which is how the product is shipped and sold.

| Term | Definition |
|---|---|
| 2 | Open Seam on Roof Substrate at all Hip and Ridge Lines |
| 3 | Hip and Ridge Shingle |
| 4 | Roofing Nail |
| 5 | Hip and Ridge Liner with Shingle Retaining Tabs or Clips |
| 10 | Base Strip |
| 12 | Centerline on Base Strip |
| 14 | Upper Release Liner |
| 16 | Lower Release Liner |
| 20 | Right External Tab |
| 22 | Right External Tab Nail Plate |

-continued

| DEFINITION LIST | |
|---|---|
| Term | Definition |
| 30 | Left External Tab |
| 32 | Left External Tab Nail Plate |
| 40 | Right Internal Tab |
| 42 | Right Internal Tab Nail Plate |
| 50 | Left Internal Tab |
| 52 | Left Internal Tab Nail Plate |
| 60 | Right Shingle Clip |
| 62 | Right Shingle Clip Nail Plate |
| 70 | Left Shingle Clip |
| 80 | Left Shingle Clip Nail Plate |
| 81 | Nail Plate Hole on Shingle Clip Nail Plate |
| 82 | Left Hook Strip Slot on Left Shingle Clip |
| 83 | Hook Strip |
| 84 | Shingle Hook on Hook Strip |
| 85 | Tail Hook on Hook Strip |
| 86 | Retaining Protrusion on Tail Hook |

DETAILED DESCRIPTION OF THE INVENTION

A hip line or a ridge line on a roof is a linear peak line from the intersection of two upward sloping planar segments of the roof. Ridge lines are located at the peaks of the roof. Hip lines are located toward the sides of the roof.

In all cases, there is a seam or gap between the roofing substrate or sub roof material at the hip or ridge line, in between the two upward sloping planar segments of the roof. This seam is meant to be as narrow or as small as possible however even with the utmost craftsmanship this seam or gap always measures at least ⅛ of an inch or greater. In some cases, this seam or gap can be up to 3 inches wide. To waterproof this seam or gap, it is common practice to tile or shingle over this seam with hip and ridge tiles or hip and ridge shingles 3. A hip and ridge tile is a tile with a ninety degree bend across the full length of the tile. A hip and ridge shingle 3 is a shingle with a ninety degree bend across the length of the shingle. Both of these are common products that can be purchased from any home center or roofing supplier. Hip and ridge shingles 3 are installed by overlapping the shingles from one end of the hip or ridge line to the other end of the hip or ridge line where the front of one shingle is positioned over the tail of the proceeding shingle and so on. Applicant believes this is not enough protection because current hip and ridge roofing practices yield weak spots and insufficient coverage on the hip and ridge lines of roofs. This is because somehow or someway water and wind invariably penetrate one or more hip and ridge shingles 3 or blow entire hip and ridge shingles 3 off the roof, leaving a wide open seam in the roof exposed to the elements to yield substantial leaks through the seam, causing substantial damages to the home that are very expensive to repair.

The use of hip and ridge liner with shingle retaining tabs or clips 5 prevents this damage by providing a sturdy seal across the entire seam or gap in the roofing substrate or sub roof in a hip and ridge line. Hip and ridge liner with shingle retaining tabs or clips 5 is first installed over the seam or gap in the roofing substrate or sub roof and then hip and ridge shingles are installed on top of the hip and ridge liner with shingle retaining tabs or clips 5. Also, through the use of external tabs, internal tabs, or shingle clips, the hip and ridge shingles 3 are securely and firmly held into place to prevent wind or rain from ever removing them or penetrating the shingles.

A main reason why hip and ridge shingles fail and/or get blown off of the roof is because roofers use nail guns to install shingles and accidentally blow the nail heads right through the shingles to leave a gap in the shingle around the nail head. This gap causes leaks at the hip or ridge line of a roof. Moreover, this gap eventually erodes into a large gaping hole around the nail which causes the shingle to leak excessively or worse yet get blown right off the roof. These failures happen because shingles are designed and made to seal around a nail with a minimum of a ⅜" head nail and to prevent a minimum of ⅜" head nails from blowing through the shingle. However, nail guns can only shoot a maximum of a ¼" inch head nail. Most roofers use nail guns to install roofs. Therefore, most roofers use ¼" head nails to install shingles where the ¼" head nails blow right through the shingles to cause these problems. In contrast, certain embodiments of this invention use nail plates that are design to accept ¼" head nails from a nail gun and to prevent the ¼" head nails from blowing through the nail plates and the shingles underneath the nail plates thereby creating a strong, secure, and leak-proof attachment of the shingles to the roof.

Hip and ridge liner with shingle retaining tabs or clips 5 comprises a base strip 10. Base strip 10 is a strip, band, belt, ribbon, swathe, or long narrow piece of material or fabric. Base strip 10 has: a length, a width, a thickness, a longitudinal axis, a longitudinal center, an upper surface, a lower surface, a leading edge, a trailing edge, a left edge, and a right edge. Base strip 10 has a length of about 2 to 250 feet. Base strip 10 has a width of about 3 to 12 inches. Base strip 10 is a waterproof barrier. Base strip 10 has a substrate made of metal, steel, aluminum, polymer, plastic, composite, wood, fiberglass, ceramic, carbon fiber, or any other known material. Substrate is layer of strong tear resistant material or fabric that is capable of receiving a coating of a roofing compound. Substrate may be a netting or open weave material to help receive the coating of roofing compound. Substrate is coated on the upper surface and the lower surface with a roofing compound such as: asphalt, tar, oil, plastic, vinyl, modified bitumen, SBS modified bitumen, rubberized asphalt, mastic resin, neoprene, polymeric film, rubberized film, plastic film, vinyl film, or any other know roofing compound that functions to seal a roof and act as a strong impenetrable water barrier. Base strip 10 is coated with a roofing compound that makes base strip an impenetrable water barrier.

The upper surface of base strip 10 has a centerline 12. Centerline 12 is a visible solid line, dashed line, or broken line running longitudinally along the full length of base strip 10 along the longitudinal center of base strip 10. Centerline 12 runs along the center of base strip 10 as depicted. Centerline 12 has a width of about ⅛ to 2 inches wide. The length of centerline 12 matches that of the base strip 10. Centerline 12 functions to provide a reference line for the roofer so that the roofer can align the centerline 12 with the open seam on roof substrate 2 during installation of hip and ridge liner with shingle retaining tabs or clips 5. This alignment ensures that the longitudinal centerline of the hip and ridge liner with shingle retaining tabs or clips 5 is coincident with the open seam on roof substrate 2 to yield an equal width of hip and ridge liner with shingle retaining tabs or clips 5 on each side of the open seam on roof substrate 2.

Figure 2:
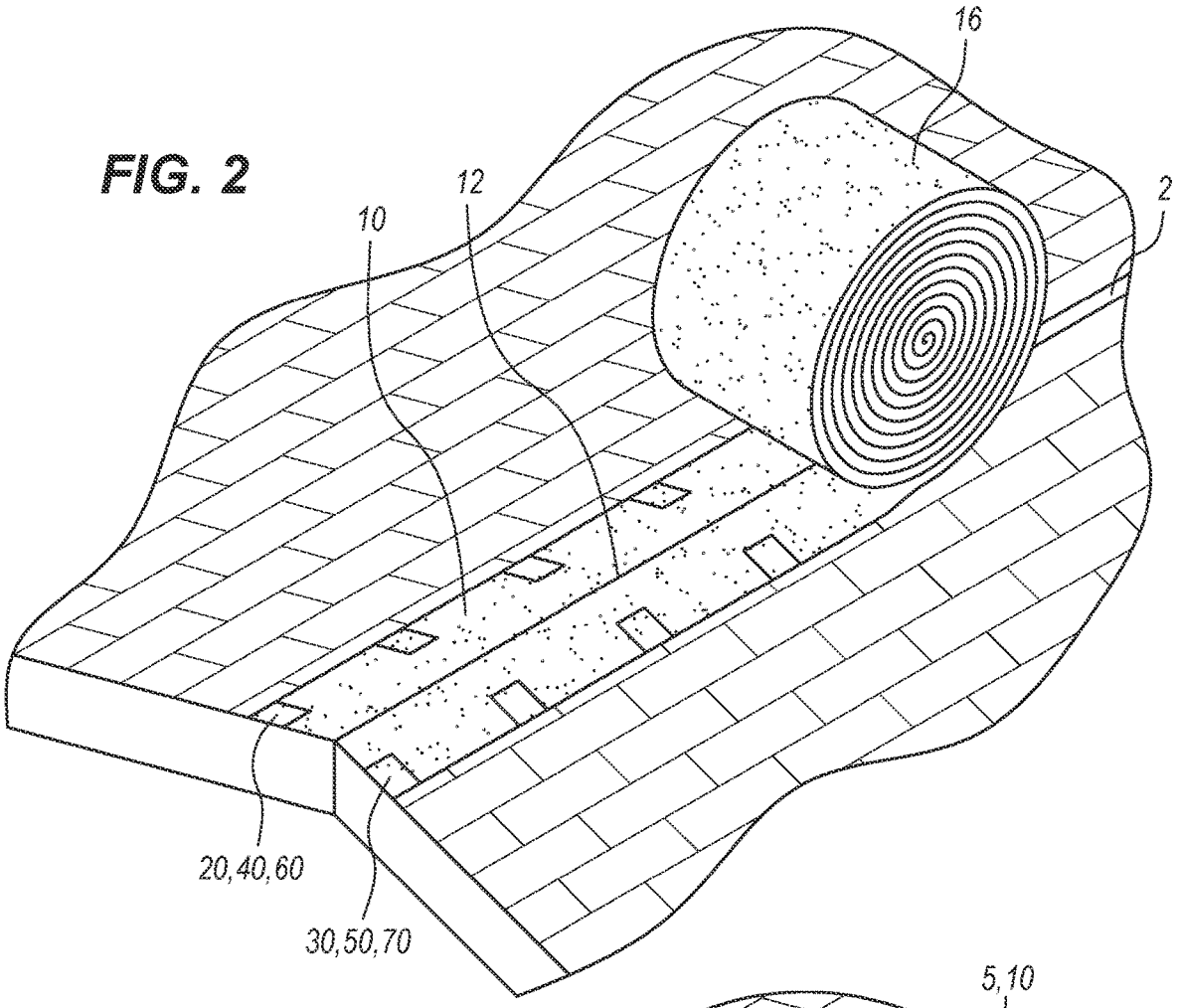
FIG. 2 is a perspective view of a roll of hip and ridge liner with shingle retaining tabs or clips being installed on a ridge line of a roof.

Hip and ridge liner with shingle retaining tabs or clips 5 is shipped and sold in rolled form or coiled form, as depicted in FIG. 1. The trailing edge of hip and ridge liner with shingle retaining tabs or clips 5 is wound into a roll in order to create a roll, spool, coil, or bolt of hip and ridge liner with shingle retaining tabs or clips 5. The outer most edge of the hip and ridge liner with shingle retaining tabs or clips 5, as it appears on the on the roll, is the leading edge of base strip and the hip and ridge liner with shingle retaining tabs or clips 5. As stated below, a roofer installs a hip and ridge liner with shingle retaining tabs or clips 5 by rolling it out over a hip or ridge line on a roof, as depicted in FIG. 2. As the roofer does this, the right edge of base strip 10 and the right edge of hip and ridge liner with shingle retaining tabs or clips 5 are on the roofer's right hand side and the left edge of base strip 10 and the left edge of hip and ridge liner with shingle retaining tabs or clips 5 are on the roofer's left hand side.

Hip and ridge liner with shingle retaining tabs or clips 5 may further comprise: a layer of pressure sensitive adhesive on its upper surface and/or an upper release liner 14 on its upper surface. It is optional for the roofing compound on the upper surface of hip and ridge liner with shingle retaining tabs or clips 5 to be of a sticky or adhesive nature wherein the roofing compound will adhere to the shingles installed on top of the hip and ridge liner with shingle retaining tabs or clips 5. Optionally further there could be layer of pressure sensitive adhesive on the upper surface of hip and ridge liner with shingle retaining tabs or clips 5 wherein the pressure sensitive adhesive will adhere to the shingles installed on top of the hip and ridge liner with shingle retaining tabs or clips 5. Any known type of pressure sensitive adhesive may be used. In these embodiments, the upper surface of hip and ridge liner with shingle retaining tabs or clips 5 would require an upper release liner 14 to prevent the hip and ridge liner with shingle retaining tabs or clips 5 from sticking to itself as it was rolled up for shipping and retail sale. Upper release liner 14 is a non-adherent material with an upper surface and a lower surface. The upper surface and/or the lower surface is coated with a release agent, such as a wax, fatty ester, silicone, metallic soap, or another chemical used to prevent the roofing compound or pressure sensitive adhesive from bonding to the release agent. Upper release liner 14 has a length, a width, a longitudinal axis, a leading edge, a trailing edge, a left edge, and a right edge that matches those of base strip 10.

Hip and ridge liner with shingle retaining tabs or clips 5 may further comprise: a layer of pressure sensitive adhesive on its lower surface and/or a lower release liner 16 on its lower surface. It is optional for the roofing compound on the lower surface of hip and ridge liner with shingle retaining tabs or clips 5 to be of a sticky or adhesive nature wherein the roofing compound will adhere to the sub roof and sub shingles underneath the hip and ridge liner with shingle retaining tabs or clips 5. Optionally further there could be a layer of pressure sensitive adhesive on the lower surface of hip and ridge liner with shingle retaining tabs or clips 5 wherein the pressure sensitive adhesive will adhere to the sub roof and sub shingles underneath the hip and ridge liner with shingle retaining tabs or clips 5. Any known type of pressure sensitive adhesive may be used. In these embodiments, the lower surface of hip and ridge liner with shingle retaining tabs or clips 5 would require a lower release liner 16 to prevent the hip and ridge liner with shingle retaining tabs or clips 5 from sticking to itself as it was rolled up for shipping and retail sale. Lower release liner 16 is a non-adherent material with an upper surface and a lower surface. The upper surface and/or the lower surface is coated with a release agent, such as a wax, fatty ester, silicone, metallic soap, or another chemical used to prevent the roofing compound or pressure sensitive adhesive from bonding to the release agent. Lower release liner 16 has a length, a width, a longitudinal axis, a leading edge, a trailing edge, a left edge, and a right edge that matches those of base strip 10.

The right edge of hip and ridge liner with shingle retaining tabs or clips 5 includes: a plurality of right external tabs 20, a plurality of right internal tabs 40, or a plurality of right shingle clips 60; and, the left edge of hip and ridge liner with shingle retaining tabs or clips 5 includes: a plurality of left external tabs 30, a plurality of left internal tabs 50, or a plurality of left shingle clips 70.

Hip and ridge liner with shingle retaining tabs or clips 5 may further comprise: a plurality of right external tabs 20 and a plurality of left external tabs 30.

Figure 3:
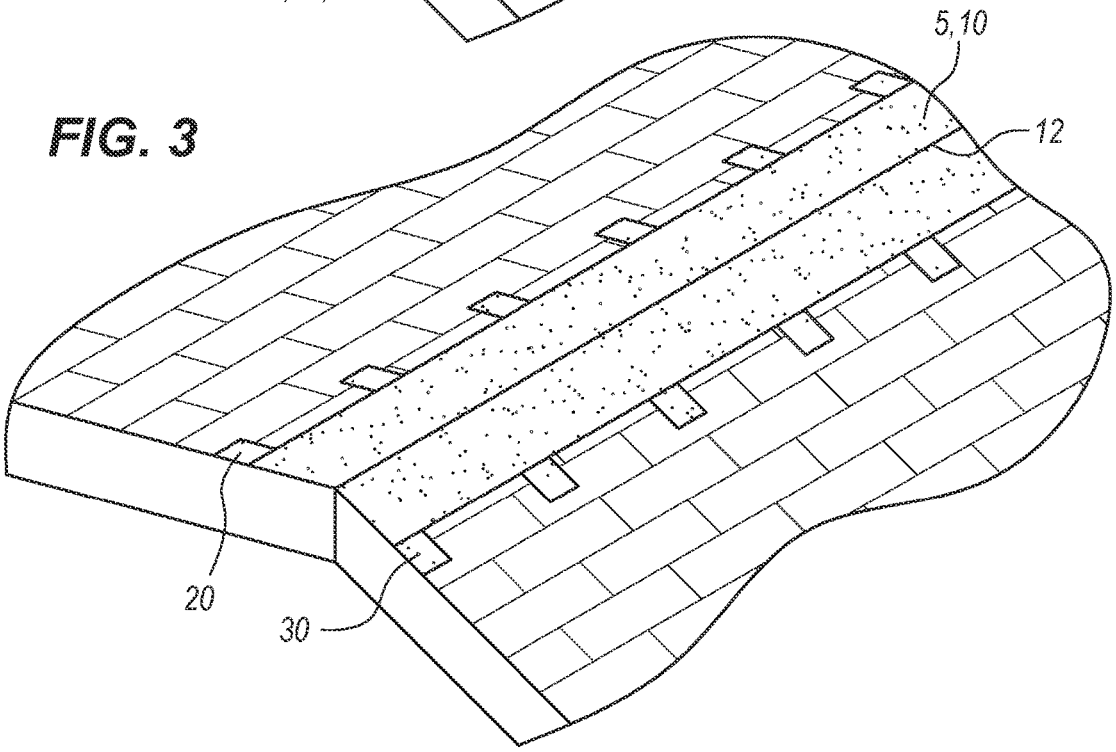
FIG. 3 is a perspective view of hip and ridge liner with shingle retaining tabs or clips, with external tabs, laid out on a ridge line of a roof, prior to installing the first hip and ridge shingle on the ridge.
Figure 4:
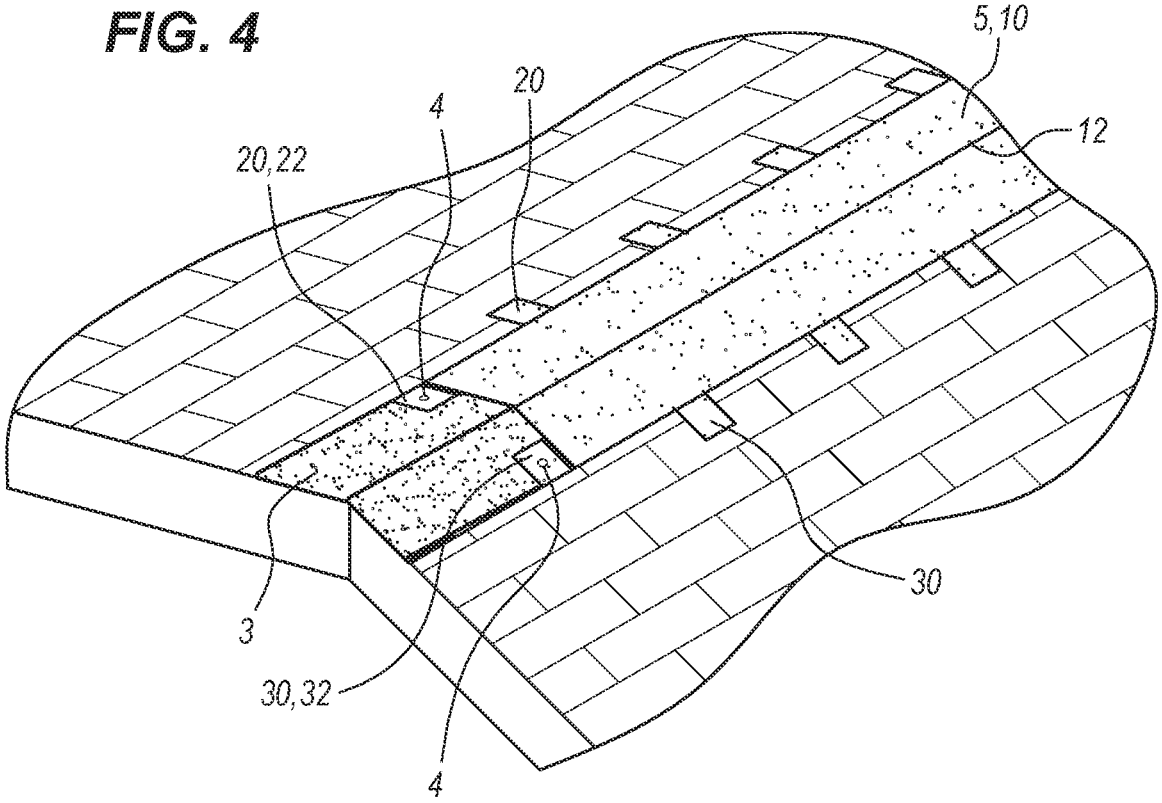
FIG. 4 is a perspective view of hip and ridge liner with shingle retaining tabs or clips, with external tabs, laid out on a ridge line of a roof, after installing the first hip and ridge shingle on the ridge.
Figure 5:
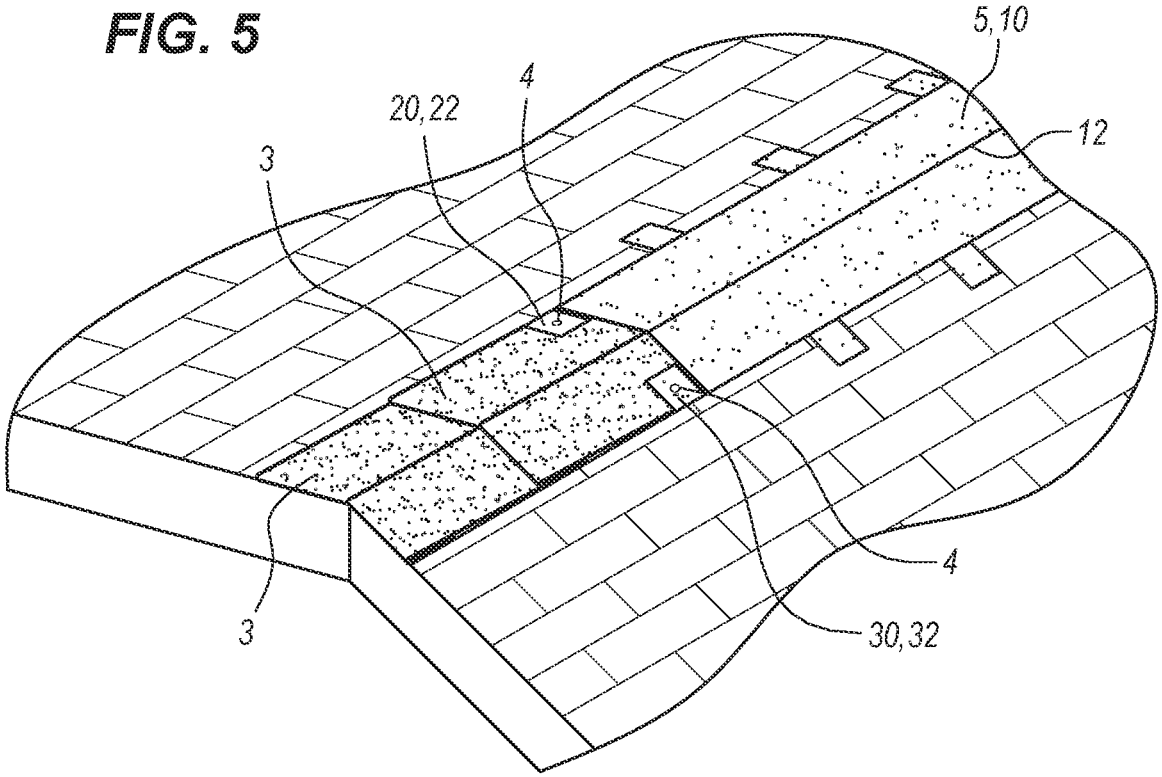
FIG. 5 is a perspective view of hip and ridge liner with shingle retaining tabs or clips, with external tabs, laid out on a ridge line of a roof, after installing the second hip and ridge shingle on the ridge.

Each right external tab 20 is a square or rectangular tab or flap of material or fabric on the right edge of base strip 10. Each right external tab 20 extends outwards from the right edge of base strip 10 to yield an ear member or outward projecting member of base strip 10. Outwards means away from the centerline 12 and inwards means towards the centerline 12. Each right external tab 20 is integral with base strip 10. Each right external tab 20 is an extension of base strip 10, of the same piece of material, and contiguous with base strip 10, without any breaks or seams in the material or substrate. Thus, with right external tabs 20, there are no holes, spaces, or breaks in the base strip 10. Each right external tab 20 extends from the right edge of base strip 10 to yield a flap or an ear that extends from the right edge of base strip 10 as depicted in FIGS. 3-5. Each right external tab 20 has a length, a width, a thickness, an upper surface, a lower surface, a leading edge, a trailing edge, an open edge, and a hinge edge. The hinge edge of each right external tab 20 is coincident with and integral with the right edge of base strip 10. The open edge of each right external tab 20 is the furthest most right edge of hip and ridge liner with shingle retaining tabs or clips 5. Each right external tab 20 has a width of about 1 to 10 inches. Each right external tab 20 has a length of about 1 to 10 inches. Each right external tab 20 is a waterproof barrier. Each right external tab 20 has a substrate made of the same material as the substrate on base strip 10. The substrate of each right external tab 20 is integral with the substrate of base strip 10. Each right external tab 20 is coated with the same roofing compound as base strip 10. The roofing compound coating on each right external tab 20 is integral with the roofing compound coating on the base strip 10. The plurality of right external tabs 20 is evenly spaced along the length of base strip 10 at a center to center distance that is equivalent to the length of a hip and ridge shingle 3 or about 5 to 25 inches.

As stated, a roofer installs a hip and ridge liner with shingle retaining tabs or clips 5 by rolling it out over a hip or ridge line on a roof, as depicted in FIG. 2. With the right external tabs 20 unfolded and extended, the open edge of each right external tab 20 is on the roofer's right hand side and the hinge edge of each right external tab 20 is on the roofer's left hand side. Also, the outer most edge of each right external tab 20, as it appears on the on the roll, is the leading edge of each right external tab 20 and the inner most edge of each right external tab 20, as it appears on the on the roll, is the trailing edge of each right external tab 20. The hinge edge of each right external tab 20 is integral with base strip 10 and without a seam or break in the fabric or material as depicted. The leading edge, open edge, and trailing edge of each right external tab 20 are open and cut or trimmed edges as depicted.

Each right external tab 20 may further comprise a right external tab nail plate 22. Each right external tab nail plate 22 is a rigid square or rectangular piece of metal or composite material. Each right external tab nail plate 22 has a length, a width, a thickness, an upper surface, a lower surface, a leading edge, a trailing edge, an open edge, and a hinge edge. The thickness of each right external tab nail plate 22 is about 1/32 to 1/2 inches. The length and width of each right external tab nail plate 22 matches those of each right external tab 20. The lower surface of each right external tab nail plate 22 is attached to the upper surface of a right external tab 20 so that the leading edge, trailing edge, hinge edge, and open edge of each right external tab nail plate 22 aligns with the leading edge, trailing edge, hinge edge, and open edge respectively of the right external tab 20 attached thereto in order to cover the upper surface of the right external tab 20. The upper surface of each right external tab 20 is the surface facing upwards with the right external tab 20 folded over base strip 10. Any known method of attachment may be used such as glue, adhesive, epoxy, chemical welding, roofing adhesive, or any other known method of attachment. Each right external tab nail plate 22 functions to prevent the head of a roofing nail 4 from penetrating the right external tab nail plate 22 and the right external tab 20 after being shot into the right external tab nail plate 22 and the right external tab 20 from a nail gun during installation of a hip and ridge shingle as stated below.

Each left external tab 30 is a square or rectangular tab or flap of material or fabric on the left edge of base strip 10. Each left external tab 30 extends outwards from the left edge of base stripe 10 to yield an ear member or outward projecting member of base strip 10. Each right external tab 20 is integral with base strip 10. Each left external tab 30 is an extension of base strip 10, of the same piece of material, and contiguous with base strip 10, without any breaks or seams in the material or substrate. Thus, with left external tabs 30, there are no holes, spaces, or breaks in the base strip 10. Each left external tab 30 extends from the left edge of base strip 10 to yield a flap or an ear that extends from the left edge of base strip 10 as depicted in FIGS. 3-5. Each left external tab 30 has a length, a width, a thickness, an upper surface, a lower surface, a leading edge, a trailing edge, an open edge, and a hinge edge. The hinge edge of each left external tab 30 is coincident with and integral with the left edge of base strip 10. The open edge of each left external tab 30 is the furthest most left edge of hip and ridge liner with shingle retaining tabs or clips 5. Each left external tab 30 has a width of about 1 to 10 inches. Each left external tab 30 has a length of about 1 to 10 inches. Each left external tab 30 is a waterproof barrier. Each left external tab 30 has a substrate made of the same material as the substrate on base strip 10. The substrate of each left external tab 30 is integral with the substrate of base strip 10. Each left external tab 30 is coated with the same roofing compound as base strip 10. The roofing compound coating on each left external tab 30 is integral with the roofing compound coating on the base strip 10. The plurality of left external tabs 30 is evenly spaced along the length of base strip 10 at a center to center distance that is equivalent to the length of a hip and ridge shingle 3 or about 5 to 25 inches.

As stated, a roofer installs a hip and ridge liner with shingle retaining tabs or clips 5 by rolling it out over a hip or ridge line on a roof, as depicted in FIG. 2. With the left external tabs 30 unfolded and extended, the open edge of each left external tab 30 is on the roofer's left hand side and the hinge edge of each left external tab 30 is on the roofer's right hand side. Also, the outer most edge of each left external tab 30, as it appears on the on the roll, is the leading edge of each left external tab 30 and the inner most edge of each left external tab 30, as it appears on the on the roll, is the trailing edge of each left external tab 30. The hinge edge of each left external tab 30 is integral with base strip 10 and without a seam or break in the fabric or material as depicted. The leading edge, open edge, and trailing edge of each left external tab 30 are open and cut or trimmed edges as depicted.

Each left external tab 30 may further comprise a left external tab nail plate 32. Each left external tab nail plate 32 is a rigid square or rectangular piece of metal or composite material. Each left external tab nail plate 32 has a length, a width, a thickness, an upper surface, a lower surface, a leading edge, a trailing edge, an open edge, and a hinge edge. The thickness of each left external tab nail plate 32 is about 1/32 to 1/2 inches. The length and width of each left external tab nail plate 32 matches those of each left external tab 30. The lower surface of each left external tab nail plate 32 is attached to the upper surface of a left external tab 30 so that the leading edge, trailing edge, hinge edge, and open edge of each left external tab nail plate 32 aligns with the leading edge, trailing edge, hinge edge, and open edge respectively of the left external tab 30 attached thereto in order to cover the upper surface of the left external tab 30. The upper surface of each left external tab 30 is the surface facing upwards with the left external tab 30 folded over base strip 10. Any known method of attachment may be used such as glue, adhesive, epoxy, chemical welding, roofing adhesive, or any other known method of attachment. Each left external tab nail plate 32 functions to prevent the head of a roofing nail 4 from penetrating the left external tab nail plate 32 and the left external tab 30 after being shot into the left external tab nail plate 32 and the left external tab 30 from a nail gun during installation of a hip and ridge shingle as stated below.

Hip and ridge liner with shingle retaining tabs or clips 5 may further comprise: a plurality of right internal tabs 40 and a plurality of left internal tabs 50.

Figure 10:
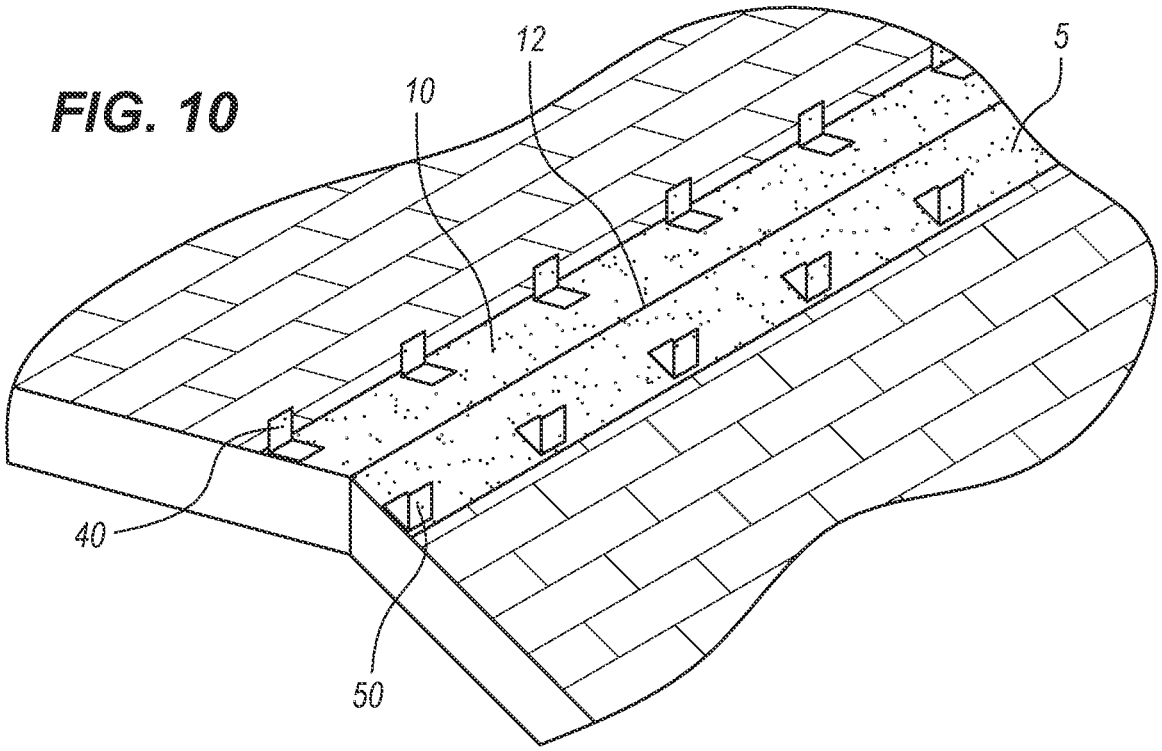
FIG. 10 is a perspective view of hip and ridge liner with shingle retaining tabs or clips, with internal tabs, laid out on a ridge line of a roof, prior to installing the first hip and ridge shingle on the ridge.
Figure 11:
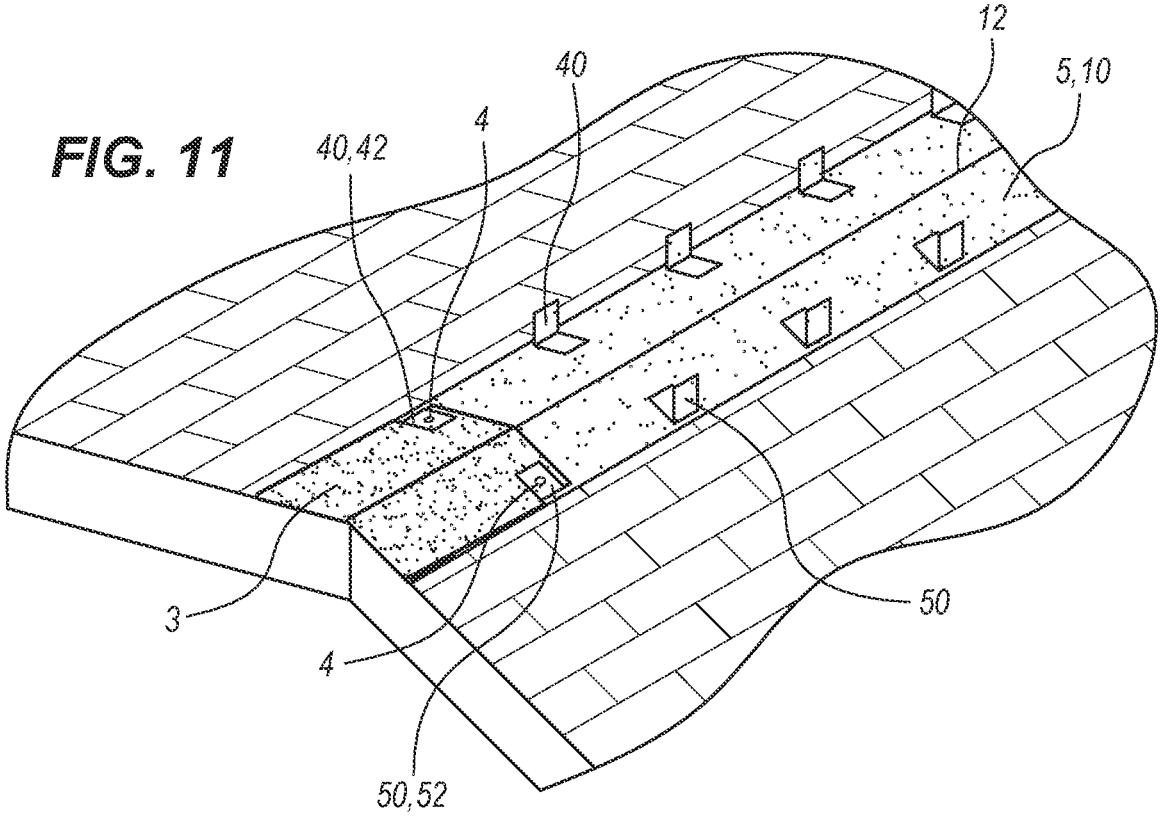
FIG. 11 is a perspective view of hip and ridge liner with shingle retaining tabs or clips, with internal tabs, laid out on a ridge line of a roof, after installing the first hip and ridge shingle on the ridge.
Figure 12:
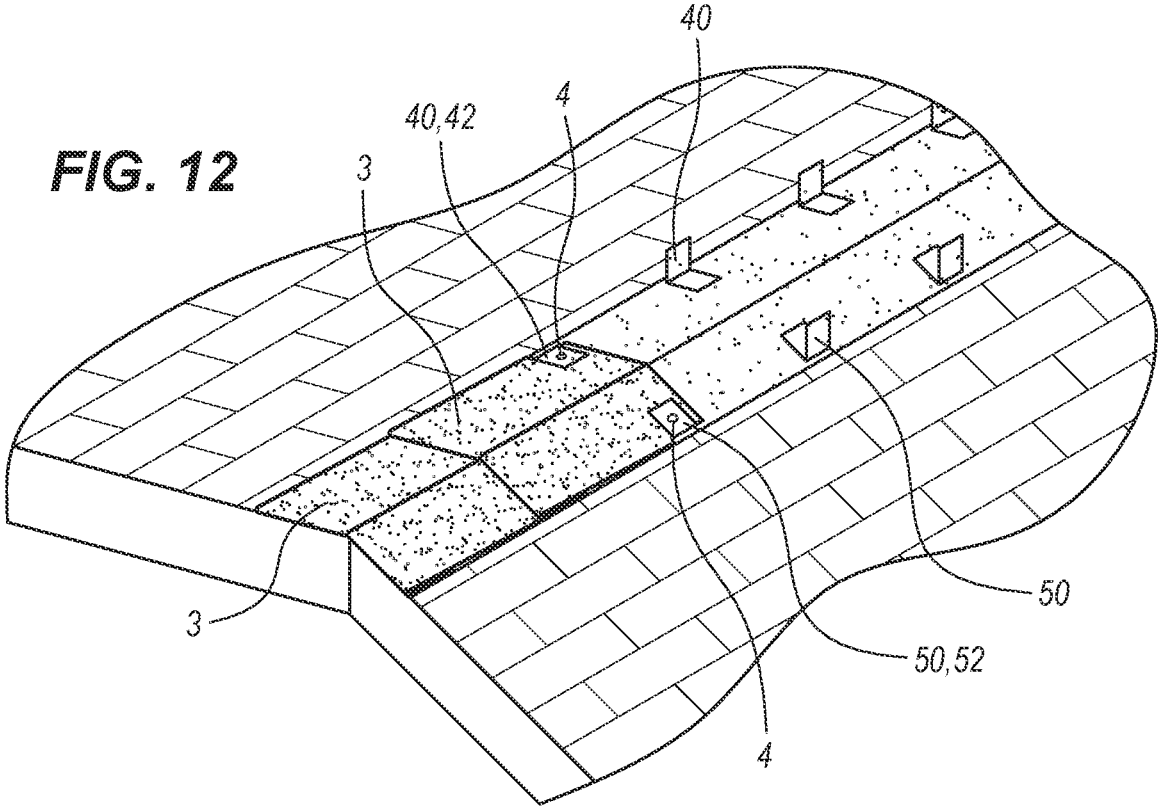
FIG. 12 is a perspective view of hip and ridge liner with shingle retaining tabs or clips, with internal tabs, laid out on a ridge line of a roof, after installing the second hip and ridge shingle on the ridge.

Each right internal tab 40 is a square or rectangular tab or flap cut into the right edge of base strip 10. Each right internal tab 40 extends inwards from the right edge of base stripe 10 and is cut from the base strip 10. Inwards means towards the centerline 12 and outwards means away from the centerline 12. Each right internal base strip 40 is integral with base strip 10 and of the same piece of material as base strip 10. Each right internal tab 40 extends inwards from the right edge of base strip 10 to yield a tab or flap in the base strip 10 as depicted in FIGS. 10-12. Each right internal tab 40 has a length, a width, a thickness, an upper surface, a lower surface, a leading edge, a trailing edge, an open edge, and a hinge edge. The hinge edge of each right internal tab 40 is adjacent to and parallel with the right edge of base strip 10. The open edge of each right internal tab 40 is adjacent to and parallel with the centerline 12. Each right internal tab 40 has a width of about 1 to 10 inches. Each right internal tab 40 has a length of about 1 to 10 inches. Each right internal tab 40 is a waterproof barrier. Each right internal tab 40 has a substrate made of the same material as the substrate on base strip 10. Each right internal tab 40 is coated with the same roofing compound as the coating on base strip 10. The plurality of right internal tabs 40 is evenly spaced along the length of base strip 10 at a center to center distance that is equivalent to the length of a hip and ridge shingle 3 or about 5 to 25 inches.

As stated, a roofer installs a hip and ridge liner with shingle retaining tabs or clips 5 by rolling it out over a hip or ridge line on a roof, as depicted in FIG. 2. With the right internal tabs 40 unfolded and extended, the open edge of each right internal tab 40 is on the roofer's right hand side and the hinge edge of each right internal tab 40 is on the roofer's left hand side. Also, the outer most edge of each right internal tab 40, as it appears on the on the roll, is the leading edge of each right internal tab 40 and the inner most edge of each right internal tab 40, as it appears on the on the roll, is the trailing edge of each right internal tab 40. The hinge edge of each right internal tab 40 is integral with base strip 10 and without a seam or break in the fabric or material as depicted. The leading edge, open edge, and trailing edge of each right internal tab 40 are open and cut or trimmed edges as depicted.

Each right internal tab 40 may further comprise a right internal tab nail plate 42. Each right internal tab nail plate 42 is a rigid square or rectangular piece of metal or composite material. Each right internal tab nail plate 42 has a length, a width, a thickness, an upper surface, a lower surface, a leading edge, a trailing edge, an open edge, and a hinge edge. The thickness of each right internal tab nail plate 42 is about 1/32 to 1/2 inches. The length and width of each right internal tab nail plate 42 matches those of each right internal tab 40. The lower surface of each right internal tab nail plate 42 is attached to the upper surface of a right internal tab 40 so that the leading edge, trailing edge, hinge edge, and open edge of each right internal tab nail plate 42 aligns with the leading edge, trailing edge, hinge edge, and open edge of the right internal tab 40 attached thereto in order to cover the upper surface of the right internal tab 40. The upper surface of each right internal tab 40 is the surface facing upwards with the right internal tab 40 unfolded. Any known method of attachment may be used such as glue, adhesive, epoxy, chemical welding, roofing adhesive, or any other known method of attachment. Each right internal tab nail plate 42 functions to prevent the head of a roofing nail 4 from penetrating the right internal tab nail plate 42 and the right internal tab 40 after being shot into the right internal tab nail plate 42 and the right internal tab 40 from a nail gun during installation of a hip and ridge shingle as stated below.

Each left internal tab 50 is a square or rectangular tab or flap cut into the left edge of base strip 10. Each left internal tab 50 extends inwards from the left edge of base stripe 10 and is cut from the base strip 10. Each left internal base strip 50 is integral with base strip 10 and of the same piece of material as base strip 10. Each left internal tab 50 extends inwards from the left edge of base strip 10 to yield a tab or flap in the base strip 10 as depicted in FIGS. 10-12. Each left internal tab 50 has a length, a width, a thickness, an upper surface, a lower surface, a leading edge, a trailing edge, an open edge, and a hinge edge. The hinge edge of each left internal tab 50 is adjacent to and parallel with the left edge of base strip 10. The open edge of each left internal tab 50 is adjacent to and parallel with the centerline 12. Each left internal tab 50 has a width of about 1 to 10 inches. Each left internal tab 50 has a length of about 1 to 10 inches. Each left internal tab 50 is a waterproof barrier. Each left internal tab 50 has a substrate made of the same material as the substrate on base strip 10. Each left internal tab 50 is coated with the same roofing compound as the coating on base strip 10. The plurality of left internal tabs 50 is evenly spaced along the length of base strip 10 at a center to center distance that is equivalent to the length of a hip and ridge shingle 3 or about 5 to 25 inches.

As stated, a roofer installs a hip and ridge liner with shingle retaining tabs or clips 5 by rolling it out over a hip or ridge line on a roof, as depicted in FIG. 2. With the left internal tabs 50 unfolded and extended, the open edge of each left internal tab 50 is on the roofer's left hand side and the hinge edge of each left internal tab 50 is on the roofer's right hand side. Also, the outer most edge of each left internal tab 50, as it appears on the on the roll, is the leading edge of each left internal tab 50 and the inner most edge of each left internal tab 50, as it appears on the on the roll, is the trailing edge of each left internal tab 50. The hinge edge of each left internal tab 50 is integral with base strip 10 and without a seam or break in the fabric or material as depicted. The leading edge, open edge, and trailing edge of each left internal tab 50 are open and cut or trimmed edges as depicted.

Each left internal tab 50 may further comprise a left internal tab nail plate 52. Each left internal tab nail plate 52 is a rigid square or rectangular piece of metal or composite material. Each left internal tab nail plate 52 has a length, a width, a thickness, an upper surface, a lower surface, a leading edge, a trailing edge, an open edge, and a hinge edge. The thickness of each left internal tab nail plate 52 is about 1/32 to 1/2 inches. The length and width of each left internal tab nail plate 52 matches those of each left internal tab 50. The lower surface of each left internal tab nail plate 52 is attached to the upper surface of a left internal tab 50 so that the leading edge, trailing edge, hinge edge, and open edge of each left internal tab nail plate 52 aligns with the leading edge, trailing edge, hinge edge, and open edge of the left internal tab 50 attached thereto in order to cover the upper surface of the left internal tab 50. The upper surface of each left internal tab 50 is the surface facing upwards with the left internal tab 50 unfolded. Any known method of attachment may be used such as glue, adhesive, epoxy, chemical welding, roofing adhesive, or any other known method of attachment. Each left internal tab nail plate 52 functions to prevent the head of a roofing nail 4 from penetrating the left internal tab nail plate 52 and the left internal tab 50 after being shot into the left internal tab nail plate 52 and the left internal tab 50 from a nail gun during installation of a hip and ridge shingle as stated below.

Hip and ridge liner with shingle retaining tabs or clips 5 may further comprise: a plurality of right shingle clips 60 and a plurality of left shingle clips 70.

Each right shingle clip 60 comprises: a right shingle clip nail plate 62 and a hook strip 83.

Right shingle clip nail plate 62 is a rigid square or rectangular piece of metal or composite material. Right shingle clip nail plate 62 has a length, a width, a thickness, an upper surface, a lower surface, a leading edge, a trailing edge, a right edge, and a left edge. The thickness of right shingle clip nail plate 62 is about 1/32 to 1/2 inches. The length of right shingle clip nail plate 62 is about 1 to 10 inches. The width of right shingle clip nail plate 62 is about 1 to 10 inches. The lower surface of each right shingle clip nail plate 62 is attached to the upper surface of base strip 10 so that the right edge of right shingle clip nail plate 62 aligns with and is coincident with the right edge of base strip 10 as depicted. Therefore, the leading edge of each right shingle clip nail plate 62 is parallel with that of base strip 10, the trailing edge of each right shingle clip nail plate 62 is parallel with that of base strip 10, and left edge of each right shingle clip nail plate 62 is parallel with that of base strip 10. Any known method of attachment may be used such as glue, adhesive, epoxy, chemical welding, roofing adhesive, or any other known method of attachment. The plurality of right shingle clips 60 is evenly spaced along the length of base strip 10 at a center to center distance that is equivalent to the length of a hip and ridge shingle 3 or about 5 to 25 inches.

Each right shingle clip nail plate 62 may have a nail plate hole 81. Nail plate hole 81 is a circular hole or void in right shingle clip nail plate 62. Nail plate hole 81 has a diameter of about 1/32 to 1/4 inches. Nail plate hole 81 is located in the center of right shingle clip nail plate 62 as depicted. Nail plate hole 81 functions to provide a clearance hole or void for a roofing nail 4 to be installed or inserted therethrough. Each right shingle clip nail plate 62 functions to prevent the head of a roofing nail 4 from penetrating the right shingle clip nail plate 62 and base strip 10 after being shot into the nail plate hole 81 and base strip 10 from a nail gun during installation of a hip and ridge shingle as stated below.

Each right shingle clip nail plate 62 has a right hook strip slot. Right hook strip slot is a slot, slit, oblong opening, or oblong hole in right shingle clip nail plate 62. Right hook strip slot has a width of about 1/16 to 1/2 inches and a length of about 0.25 to 5 inches. Right hook strip slot is located at the corner of right shingle clip nail plate 62 where the leading edge of right shingle clip nail plate 62 meets the left edge of right shingle clip nail plate 62. Right hook strip slot has a longitudinal axis that is parallel with the left edge of right shingle clip nail plate 62 and perpendicular to the leading edge of right shingle clip nail plate 62. Right hook strip slot functions to receive and retain hook strip 83. Hook strip 83 is slidably attached within right hook strip slot.

Hook strip 83 is a strip, band, belt, ribbon, swathe, or long narrow piece of metal or composite material. Hook strip 83 has a length of about 2-15 inches. Hook strip 83 has a width of about 0.25 to 10 inches. Hook strip 83 has a thickness of about 1/16 to 1/2 inches. Hook strip 83 has an upper surface and a lower surface. Hook strip has an outer end and an inner end. Hook strip 83 is shaped into an "S" or S-hook wherein the outer end has a ninety degree bend, curve, or fold that bends upward and the inner end has a ninety degree bend, curve, or fold that bends downward to make the "S" shape. The ninety degree bend or hook on the outer end is a shingle hook 84. The ninety degree bend or hook on the inner end is a tail hook 85. Shingle hook 84 is a "U" shaped or hook shaped member that functions to slide over a hip and ridge shingle 3 and to hook onto the hip and ridge shingle 3 and lock it in place as discussed below.

Tail hook 85 is a "U" shaped or hook shaped member. Tail hook 85 has an upper layer and a lower layer that make up the "U" shape or hook shape. The upper layer of tail hook 85 has a retaining protrusion 86. Retaining protrusion is a protrusion, notch, tab, or flap of hook strip 83 that las been cut into hook strip 83 and pushed downward slightly. No material is removed from hook strip 83. A notch, tab, or flap is simply cut and pushed or bent downwards to leave a notch, tab, or flap pointing downwards. The hinged portion of the retaining protrusion 86 is adjacent to the tail hook 85 end of hook strip 83 and the open portion of the retaining protrusion 86 is adjacent to the shingle hook 84 end of hook strip 83. Optionally, the lower layer of tail hook 85 may have the retaining protrusion 86, wherein the protrusion, notch, tab, or flap of hook strip 83 that has been cut into hook strip 83 is pushed upwards.

Retaining protrusion 86 functions to lock or secure hook strip 83 in place after hook strip 83 has been slid or moved inwards towards the centerline 12 to secure or lock the shingle hook 84 onto an installed hip and ridge shingle 3 thereby preventing the hook strip 83 from sliding back outwards or away from the centerline 12 and locking in the secured hip and ridge shingle 3. Retaining protrusion 86 right shingle clips 60 locks into place because the bent notch, tab, or flap catches on the left edge of right shingle clip nail plate 62 when the shingle hook is slid or moved over hip and ridge shingle 3 wherein the retaining protrusion catches on the left edge of right shingle clip nail plate 62. Retaining protrusion 86 prevents hook strip from sliding back out, thereby locking in the hip and ridge shingle 3.

Each left shingle clip 70 comprises: a left shingle clip nail plate 80 and a hook strip 83.

Left shingle clip nail plate 80 is a rigid square or rectangular piece of metal or composite material. Left shingle clip nail plate 80 has a length, a width, a thickness, an upper surface, a lower surface, a leading edge, a trailing edge, a right edge, and a left edge. The thickness of left shingle clip nail plate 80 is about 1/32 to 1/2 inches. The length of left shingle clip nail plate 80 is about 1 to 10 inches. The width of left shingle clip nail plate 80 is about 1 to 10 inches. The lower surface of each left shingle clip nail plate 80 is attached to the upper surface of base strip 10 so that the left edge of left shingle clip nail plate 80 aligns with and is coincident with the left edge of base strip 10 as depicted. Therefore, the leading edge of each left shingle clip nail plate 80 is parallel with that of base strip 10, the trailing edge of each left shingle clip nail plate 80 is parallel with that of base strip 10, and right edge of each left shingle clip nail plate 80 is parallel with that of base strip 10. Any known method of attachment may be used such as glue, adhesive, epoxy, chemical welding, roofing adhesive, or any other known method of attachment. The plurality of left shingle clips 70 is evenly spaced along the length of base strip 10 at a center to center distance that is equivalent to the length of a hip and ridge shingle 3 or about 5 to 25 inches.

Each left shingle clip nail plate 80 may have a nail plate hole 81. Nail plate hole 81 is a circular hole or void in left shingle clip nail plate 80. Nail plate hole 81 has a diameter of about 1/32 to 1/4 inches. Nail plate hole 81 is located in the center of left shingle clip nail plate 80 as depicted. Nail plate hole 81 functions to provide a clearance hole or void for a roofing nail 4 to be installed or inserted therethrough. Each left shingle clip nail plate 80 functions to prevent the head of a roofing nail 4 from penetrating the left shingle clip nail plate 80 and base strip 10 after being shot into the nail plate hole 81 and base strip 10 from a nail gun during installation of a hip and ridge shingle as stated below.

Each left shingle clip nail plate 80 has a left hook strip slot 82. Left hook strip slot 82 is a slot, slit, oblong opening, or oblong hole in left shingle clip nail plate 80. Left hook strip slot 82 has a width of about 1/16 to 1/2 inches and a length of about 0.25 to 5 inches. Left hook strip slot 82 is located at the corner of left shingle clip nail plate 80 where the leading edge of left shingle clip nail plate 80 meets the right edge of left shingle clip nail plate 80. Left hook strip slot 82 has a longitudinal axis that is parallel with the right edge of left shingle clip nail plate 80 and perpendicular to the leading edge of left shingle clip nail plate 80. Left hook strip slot 82 functions to receive and retain hook strip 83. Hook strip 83 is slidably attached within left hook strip slot 82.

Hook strip 83 is a strip, band, belt, ribbon, swathe, or long narrow piece of metal or composite material. Hook strip 83 has a length of about 2-15 inches. Hook strip 83 has a width of about 0.25 to 10 inches. Hook strip 83 has a thickness of about 1/16 to 1/2 inches. Hook strip 83 has an upper surface and a lower surface. Hook strip has an outer end and an inner end. Hook strip 83 is shaped into an "S" or S-hook wherein the outer end has a ninety degree bend, curve, or fold that bends upward and the inner end has a ninety degree bend, curve, or fold that bends downward to make the "S" shape. The ninety degree bend on the outer end is a shingle hook 84. The ninety degree bend on the inner end is a tail hook 85. Shingle hook 84 is a "U" shaped or hook shaped member that functions to slide over a hip and ridge shingle 3 and to hook onto the hip and ridge shingle 3 and lock it in place as discussed below.

Tail hook 85 is a "U" shaped or hook shaped member. Tail hook 85 has an upper layer and a lower layer that make up the "U" shape or hook shape. The upper layer of tail hook 85 has a retaining protrusion 86. Retaining protrusion is a protrusion, notch, tab, or flap of hook strip 83 that las been cut into hook strip 83 and pushed downward. No material is removed from hook strip 83. A notch, tab, or flap is simply cut and pushed or bent downwards to leave a notch, tab, or flap pointing downwards. The hinged portion of the retaining protrusion 86 is adjacent to the tail hook 85 end of hook strip 83 and the open portion of the retaining protrusion 86 is adjacent to the shingle hook 84 end of hook strip 83. Optionally, the lower layer of tail hook 85 may have the retaining protrusion 86, wherein the protrusion, notch, tab, or flap of hook strip 83 that has been cut into hook strip 83 is pushed upwards.

Retaining protrusion 86 functions to lock or secure hook strip 83 in place after hook strip 83 has been slid or moved inwards towards the centerline 12 to secure or lock the shingle hook 84 onto an installed hip and ridge shingle 3 thereby preventing the hook strip 83 from sliding back outwards or away from the centerline 12 and locking in the secured hip and ridge shingle 3. Retaining protrusion 86 on left shingle clips 70 locks into place because the bent notch, tab, or flap catches on the right edge of left shingle clip nail plate 80 when the shingle hook is slid or moved over hip and ridge shingle 3 wherein the retaining protrusion catches on the right edge of left shingle clip nail plate 80. Retaining protrusion 86 prevents hook strip from sliding back out, thereby locking in the hip and ridge shingle 3.

In order to install hip and ridge liner with shingle retaining tabs or clips 5 onto a ridge line or a hip line of a roof, the leading edge of base strip 10 is placed at the first end of the ridge line or a hip line and then the install hip and ridge liner with shingle retaining tabs or clips 5 is rolled out in order to cover the entire ridge line or a hip line as depicted in FIG. 2. Next the hip and ridge liner with shingle retaining tabs or clips 5 is trimmed to length to match that of the ridge line or a hip line. Then the hip and ridge shingles 3 are installed over the hip and ridge liner with shingle retaining tabs or clips 5 in the usual overlapped method while securing the hip and ridge shingles 3 with the tabs or clips of this invention to yield an impenetrable and impermeable protection layer over the hip or ridge line of a roof.

With the embodiment of hip and ridge liner with shingle retaining tabs or clips 5 with external tabs 20,30, the left and right external tabs 20,30 are unfolded outwards to provide space to install the hip and ridge shingles 3 as depicted in FIG. 3. Then the first hip and ridge shingle 3 is installed, wherein the hip and ridge shingle 3 is placed into position, then the first right external tab 20 and the first left external tab 30 are folded over the first hip and ridge shingle 3 and a roofing nail 4 is installed or inserted into the first right external tab 20 and the first left external tab 30, as depicted in FIG. 4. Then the second hip and ridge shingle 3 is installed, wherein the hip and ridge shingle 3 is placed into position, properly overlapping the first hip and ridge shingle 3, then the second right external tab 20 and the second left external tab 30 are folded over the second hip and ridge shingle 3 and a roofing nail 4 is installed or inserted into the second right external tab 20 and the second left external tab 30, as depicted in FIG. 5. Next, this procedure is repeated all the way done the line of hip or ridge line of the roof until the full hip or ridge line of the roof is completely shingled.

With the embodiment of hip and ridge liner with shingle retaining tabs or clips 5 with internal tabs 40,50, the left and right internal tabs 40,50 are unfolded outwards to provide space to install the hip and ridge shingles 3 as depicted in FIG. 10. Then the first hip and ridge shingle 3 is installed, wherein the hip and ridge shingle 3 is placed into position, then the first right internal tab 40 and the first left internal tab 50 are folded over the first hip and ridge shingle 3 and a roofing nail 4 is installed or inserted into the first right internal tab 40 and the first left internal tab 50, as depicted in FIG. 11. Then the second hip and ridge shingle 3 is installed, wherein the hip and ridge shingle 3 is placed into position, properly overlapping the first hip and ridge shingle 3, then the second right internal tab 40 and the second left internal tab 50 are folded over the second hip and ridge shingle 3 and a roofing nail 4 is installed or inserted into the second right internal tab 40 and the second left internal tab 50, as depicted in FIG. 12. Next, this procedure is repeated all the way done the line of hip or ridge line of the roof until the full hip or ridge line of the roof is completely shingled.

Figure 6:
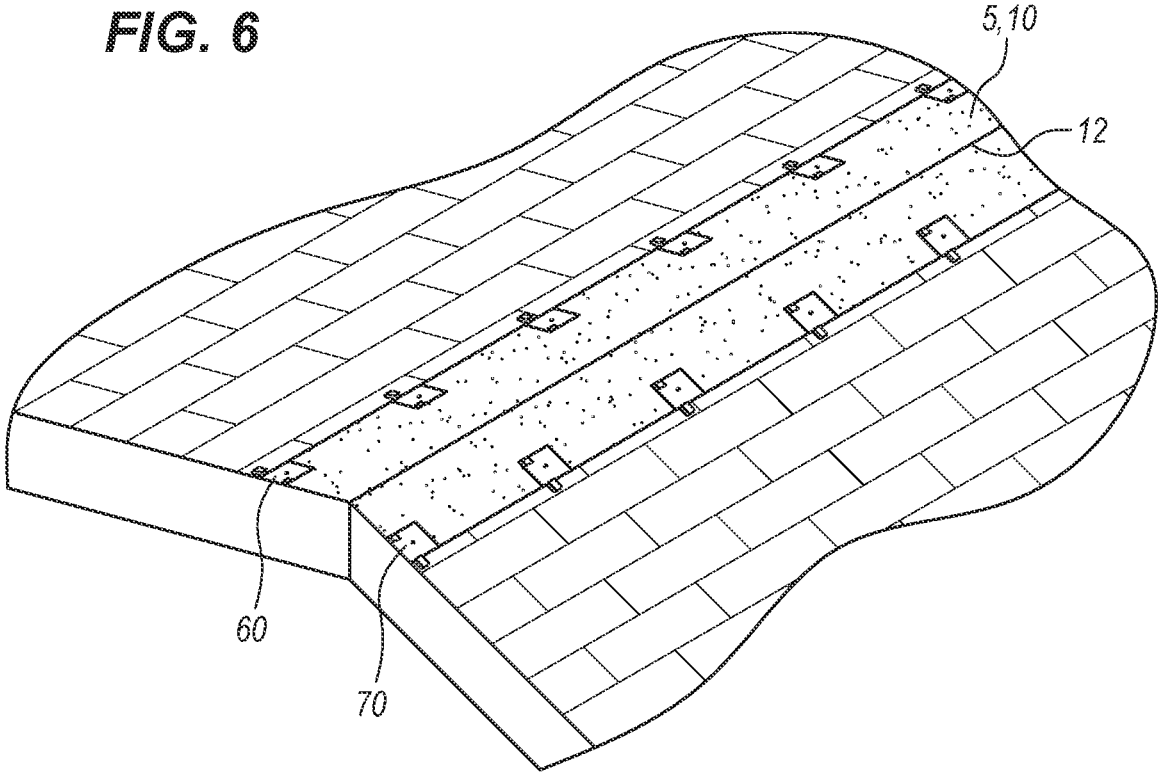
FIG. 6 is a perspective view of hip and ridge liner with shingle retaining tabs or clips, with shingle clips, laid out on a ridge line of a roof, prior to installing the first hip and ridge shingle on the ridge.
Figure 7:
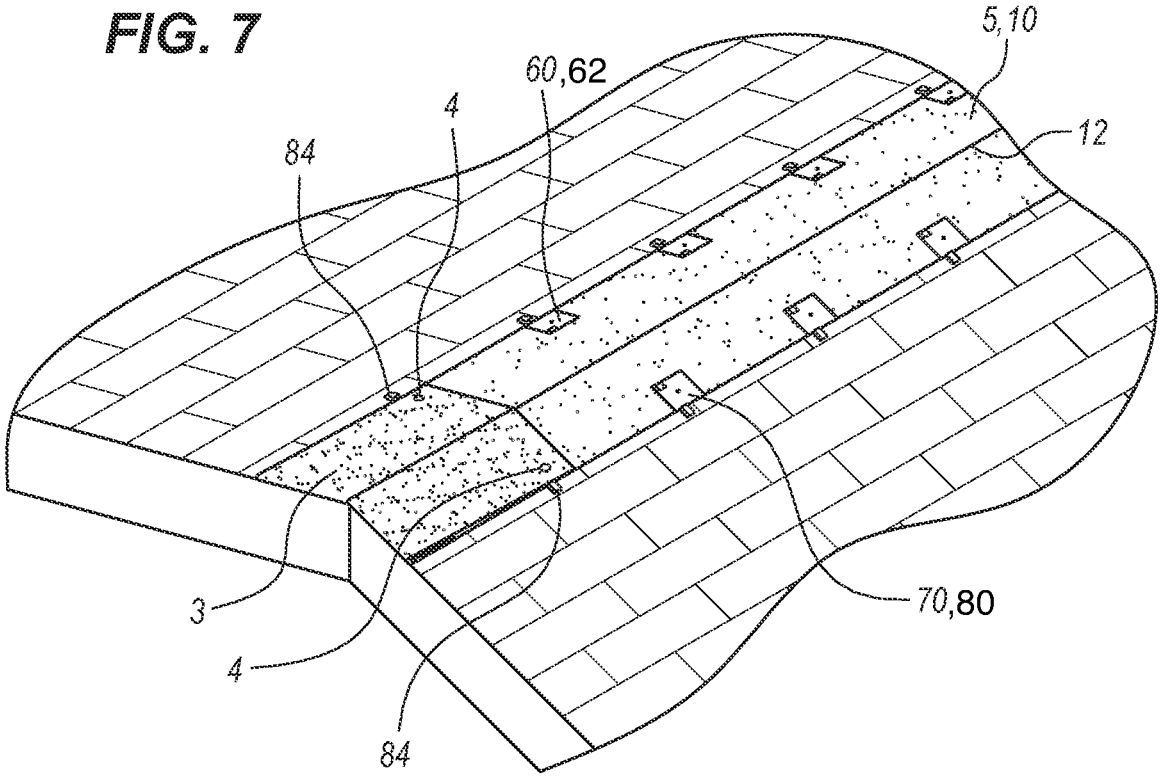
FIG. 7 is a perspective view of hip and ridge liner with shingle retaining tabs or clips, with shingle clips, laid out on a ridge line of a roof, after installing the first hip and ridge shingle on the ridge.
Figure 8:
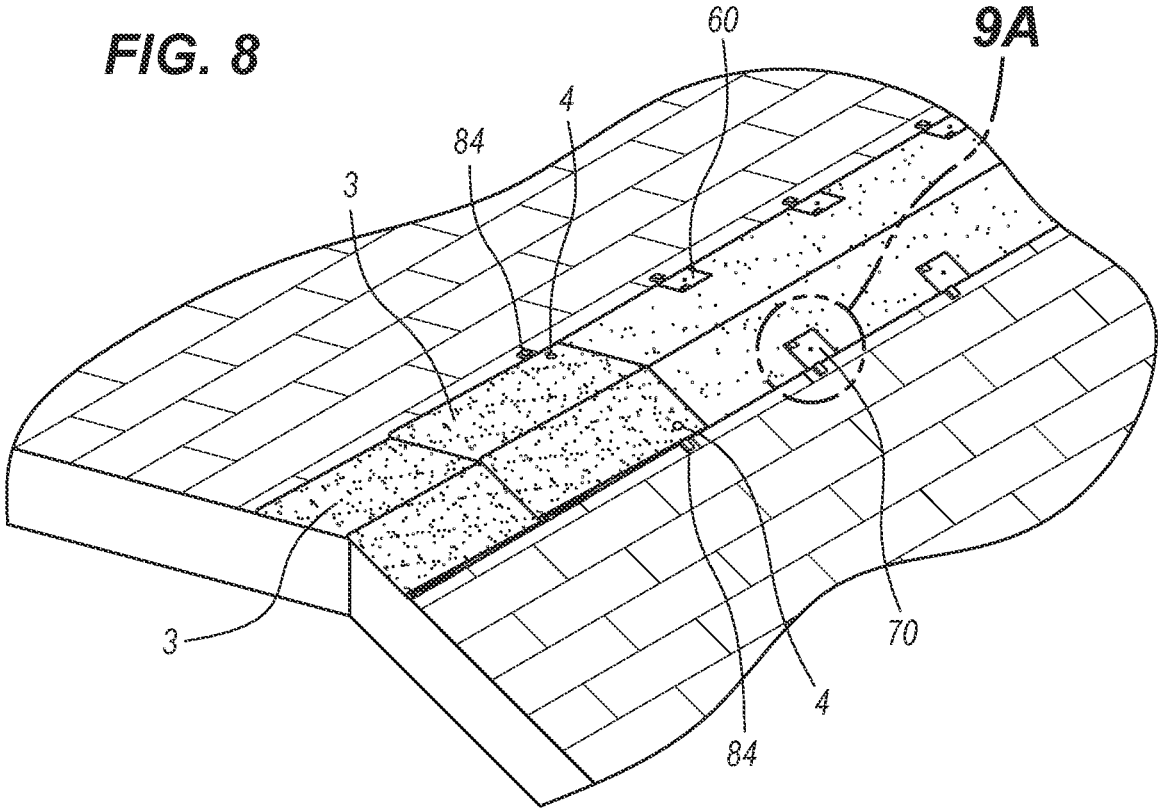
FIG. 8 is a perspective view of hip and ridge liner with shingle retaining tabs or clips, with shingle clips, laid out on a ridge line of a roof, after installing the second hip and ridge shingle on the ridge.
Figure 9A:
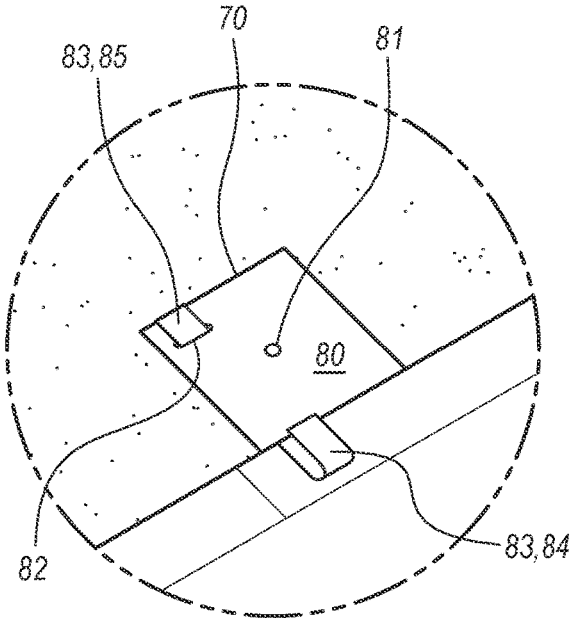
FIG. 9A is an enlarged view of a left shingle clip in the open and unhooked position and prior to installing the first hip and ridge shingle on the ridge.
Figure 9B:
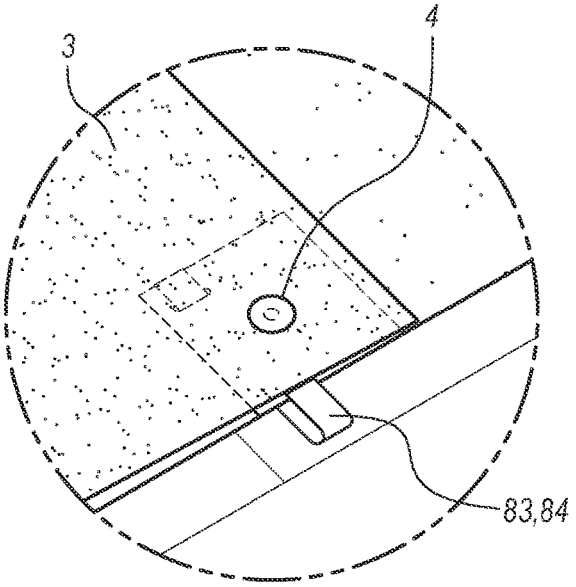
FIG. 9B is an enlarged view of a left shingle clip in the open and unhooked position and after installing the first hip and ridge shingle on the ridge.
Figure 9C:
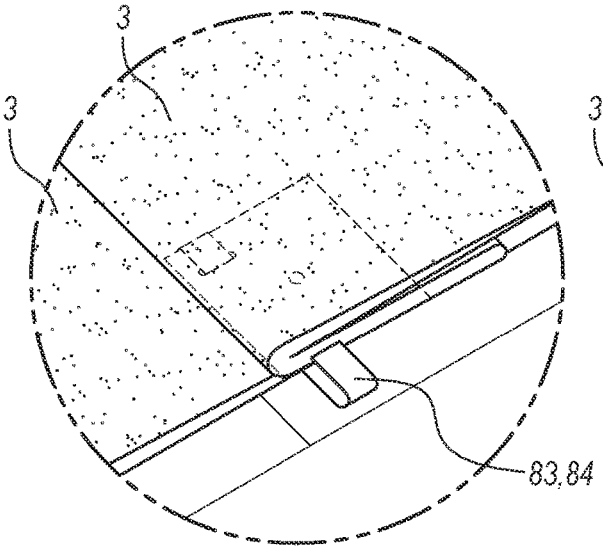
FIG. 9C is an enlarged view of a left shingle clip in the open and unhooked position and after installing the second hip and ridge shingle on the ridge.
Figure 9D:
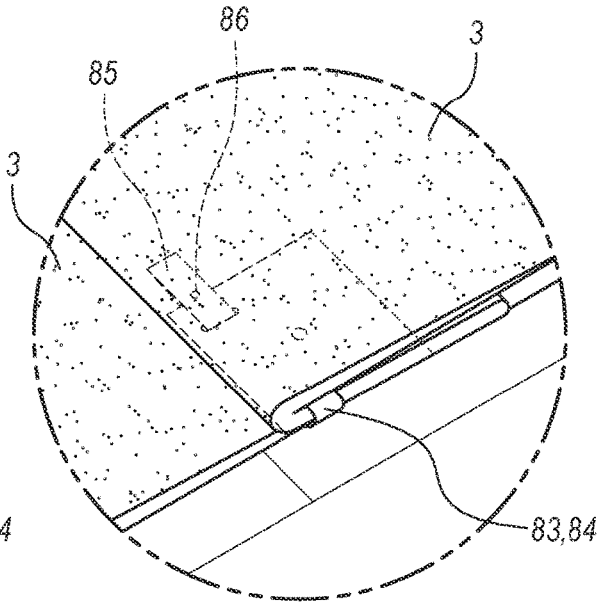
FIG. 9D is an enlarged view of a left shingle clip in the closed and hooked position and after locking in the first hip and ridge shingle on the ridge.

With the embodiment of hip and ridge liner with shingle retaining tabs or clips 5 with shingle clips 60,70, the hooks strips 83 in the left and right shingle clips 60,70 are slid or moved outwards to allow space to install the hip and ridge shingles 3 as depicted in FIGS. 6 and 9A. Then the first hip and ridge shingle 3 is installed, wherein the hip and ridge shingle 3 is placed into position, then and a roofing nail 4 is installed or inserted into the first right shingle clip 60 and the first left shingle clip 70, as depicted in FIGS. 7 and 9B. Then the second hip and ridge shingle 3 is installed, wherein the hip and ridge shingle 3 is placed into position, properly overlapping the first hip and ridge shingle 3, then and a roofing nail 4 is installed or inserted into the second right shingle clip 60 and the second left shingle clip 70, as depicted in FIG. 9C. Then the hook strips 83 and shingle hooks 84 on the first right shingle clip 60 and the first left shingle clip 70 are slid or moved into lock position wherein the shingle hooks 84 on the first right shingle clip 60 and the first left shingle clip 70 are moved toward the centerline 12 on base strip 10 to clamp onto the edges of the first hip and ridge shingle 3 in order to lock the first hip and ridge shingle 3 onto the roof, as depicted in FIG. 9D. Next, this procedure is repeated all the way done the line of hip or ridge line of the roof until the full hip or ridge line of the roof is completely shingled.

Using this invention will essentially keep the hip line and ridge lines of a roof completely waterproof and weather proof for many many years thereby saving the homeowner a considerable amount of maintenance costs over the course of the lifespan of the home.

What is claimed is:

1. A hip and ridge liner with shingle retaining tabs or clips comprising: a base strip; a plurality of right external tabs; and a plurality of left external tabs, wherein, said base strip is a strip, band, belt, ribbon, swathe, or long narrow piece of material or fabric, said base strip has a length, a width, a thickness, a longitudinal axis, a longitudinal center, an upper surface, a lower surface, a leading edge, a trailing edge, a left edge, and a right edge, said base strip is coated on said upper surface and said lower surface with a roofing compound that renders said base strip waterproof, said upper surface of said base strip has a centerline, said centerline is a visible solid line, dashed line, or broken line running longitudinally along said longitudinal center of said base strip, each of said plurality of right external tabs is a square or rectangular tab or flap of material or fabric extending outward from said right edge of said base strip, each of said plurality of right external tabs is an ear member or outward projecting member on said base strip, each of said plurality of right external tabs is integral with said base strip and contiguous with said base strip, without any breaks or seams there between, each of said plurality of right external tabs has a length, a width, a thickness, an upper surface, a lower surface, a leading edge, a trailing edge, an open edge, and a hinge edge, each of said plurality of right external tabs is coated on said upper surface and said lower surface with said roofing compound that renders each of said plurality of right external tabs waterproof, each of said plurality of right external tabs is evenly spaced along said length of said base strip, each of said plurality of left external tabs is a square or rectangular tab or flap of material or fabric extending outward from said left edge of said base strip, each of said plurality of left external tabs is an ear member or outward projecting member on said base strip, each of said plurality of left external tabs is integral with said base strip and contiguous with said base strip, without any breaks or seams there between, each of said plurality of left external tabs has a length, a width, a thickness, an upper surface, a lower surface, a leading edge, a trailing edge, an open edge, and a hinge edge, each of said plurality of left external tabs is coated on said upper surface and said lower surface with said roofing compound that renders each of said plurality of left external tabs waterproof, and each of said plurality of left external tabs is evenly spaced along said length of said base strip.

2. A hip and ridge liner with shingle retaining tabs or clips comprising as recited in claim 1 further comprising: an upper release liner and a lower release liner, wherein, said upper release liner is a sheet of non-adherent material with a surface that is coated with a release agent used to prevent said roofing compound or a pressure sensitive adhesive from bonding to said release agent, said surface of said upper release liner is reversibly attached to said upper surface of said base strip, said lower release liner is a sheet of non-adherent material with a surface that is coated with a release agent used to prevent said roofing compound or a pressure sensitive adhesive from bonding to said release agent, and said surface of said lower release liner is reversibly attached to said lower surface of said base strip.

3. A hip and ridge liner with shingle retaining tabs or clips comprising as recited in claim 1 further comprising: a plurality of right external nail plates and a plurality of left external nail plates, wherein, each of said plurality of right external tab nail plates is a rigid square or rectangular piece of metal or composite material with a length, a width, a thickness, an upper surface, a lower surface, a leading edge, a trailing edge, an open edge, and a hinge edge, said lower surface of each of said right external tab nail plates is attached to said upper surface of each of said plurality of right external tabs so that said leading edge, said trailing edge, said hinge edge, and said open edge of each of said plurality of right external tab nail plates aligns with said leading edge, said trailing edge, said hinge edge, and said open edge respectively of each of said plurality of right external tabs attached thereto in order to cover said upper surface of each of said plurality of right external tabs, each of said plurality of left external tab nail plates is a rigid square or rectangular piece of metal or composite material with a length, a width, a thickness, an upper surface, a lower surface, a leading edge, a trailing edge, an open edge, and a hinge edge, and said lower surface of each of said left external tab nail plates is attached to said upper surface of each of said plurality of left external tabs so that said leading edge, said trailing edge, said hinge edge, and said open edge of each of said plurality of left external tab nail plates aligns with said leading edge, said trailing edge, said hinge edge, and said open edge respectively of each of said plurality of left external tabs attached thereto in order to cover said upper surface of each of said plurality of left external tabs.

4. A hip and ridge liner with shingle retaining tabs or clips comprising as recited in claim 3 further comprising: an upper release liner and a lower release liner, wherein, said upper release liner is a sheet of non-adherent material with a surface that is coated with a release agent used to prevent said roofing compound or a pressure sensitive adhesive from bonding to said release agent, said surface of said upper release liner is reversibly attached to said upper surface of said base strip, said lower release liner is a sheet of non-adherent material with a surface that is coated with a release agent used to prevent said roofing compound or a pressure sensitive adhesive from bonding to said release agent, and said surface of said lower release liner is reversibly attached to said lower surface of said base strip.

* * * * *